US006152554A

United States Patent [19]

Parisi

[11] Patent Number: 6,152,554

[45] Date of Patent: Nov. 28, 2000

[54] ADJUSTABLE HINGE ASSEMBLY

[75] Inventor: Bernard Parisi, Barnegat, N.J.

[73] Assignee: Component Hardware Group, Inc., Lakewood, N.J.

[21] Appl. No.: 09/409,622

[22] Filed: Oct. 1, 1999

[51] Int. Cl.[7] ..... E05D 7/04

[52] U.S. Cl. ..... 312/405; 16/249; 49/236; 49/382

[58] Field of Search ..... 16/235, 236, 239, 16/382, 249; 312/405, 326, 329; 49/236, 382, 381, 388

[56] References Cited

U.S. PATENT DOCUMENTS

| | | | |
|---|---|---|---|
| 1,141,303 | 6/1915 | Bennett et al. | 16/249 |
| 4,304,027 | 12/1981 | Di Fazio | 16/249 |

FOREIGN PATENT DOCUMENTS

| | | | |
|---|---|---|---|
| 3601497 | 7/1987 | Germany | 16/382 |
| 5-71261 | 3/1993 | Japan | 16/236 |
| 2225608 | 6/1990 | United Kingdom | 16/249 |

*Primary Examiner*—Janet M. Wilkens
*Attorney, Agent, or Firm*—Francis C. Hand, Esq.; Carella, Byrne, Bain, Gilfillan, Cecchi, Stewart & Olstein

[57] ABSTRACT

The housing of a hinge assembly is provided with elongated apertures and a plate of less width than the housing is clamped over the apertures by mounting screws which secure the housing to a cabinet. The housing wall and the surface of the plate are serrated to secure the plate against lateral movement after being clamped to the housing. A cover is snap-fitted onto the housing to seal off the elongated apertures and to eliminate any exposed gaps.

15 Claims, 2 Drawing Sheets

ADJUSTABLE HINGE ASSEMBLY

This invention relates to an adjustable hinge assembly. More particularly, this invention relates to an adjustable hinge assembly for a refrigerated cabinet.

Heretofore, various types of hinge assemblies have been known for mounting a door on a refrigerated cabinet. For example, commercial reach-in refrigerators, such as soft drink type display units as well as other refrigerators have used hinges which permit a door to be swung from a closed position to either a predetermined partially opened position or a fully opened position relative to the cabinet. Typically, these types of hinges have had a housing secured to the cabinet and a bracket mounted to the door with cam surfaces between the housing and bracket to allow for positioning of the door in one or the other of the opened positions. Generally, the only adjustment is on the bracket in order to allow the door to move in or out against the surface of the cabinet. This movement allows for a positive seal against a gasket that separates the door from the cabinet.

Generally, the refrigerated cabinets have been manufactured with preformed bores to receive mounting screws for subsequently mounting the hinge housings in-place. However, if the bores or if the hinge housings are not accurately placed, there is a risk that the post members will be out of line and that the doors may not be mounted square to the edge of the cabinet.

One of the requirements for mounting any type of hinge on a refrigerated cabinet is that the mounting be free of gaps, particularly gaps within which bacteria, microbes and the like may exist.

Accordingly, it is an object of this invention to provide a hinge assembly which can be easily adjusted in place in order to correct misalignments in the mounting of a door on a refrigerated cabinet.

It is another object of this invention to simplify the making of adjustments in a hinge assembly.

It is another object of this invention to be able to make adjustments in the mounting of a hinge in a relatively simple manner with simple tools.

It is another object the invention to provide a hinge assembly with adjusting means which can be sealed in-place without any exposed gaps.

Briefly, the invention is directed to a hinge assembly for a refrigerated cabinet comprised of a housing and a post member pivotally mounted on the housing.

The housing is formed with a wall with a plurality of apertures through which mounting screws or the like are passed to secure the housing to the refrigerated cabinet.

In accordance with the invention, the apertures in the housing are of elongated shape and an elongated plate is disposed against the wall of housing over the apertures in the wall. This plate also has a plurality of apertures which are disposed over the apertures in the housing wall and through which the mounting screws are passed in order to clamp the plate to the wall. In addition, the wall is provided with a plurality of serrations while the plate is provided with serrations in selective engagement with the serrations of the wall in order to ensure that the plate remains in a fixed position should the mounting screws become loose.

During mounting of the housing component of the hinge on the refrigerated cabinet, the apertures in the housing wall are aligned with preformed apertures in the cabinet. Next, the plate is positioned against the serrated wall of the housing and the mounting screws passed through the plate and housing into the cabinet. Thereafter, the door with the post member of the hinge thereon is mounted on the cabinet by disposing the post member on the hinge housing.

In the event that an adjustment is required, the mounting screws of the hinge assembly are loosened, for example by using a screw driver, so that the housing component of the hinge may be moved laterally of the cabinet and the plate. Once the housing has been brought to a new position, the screws are tightened so that the plate is brought into clamping engagement with the housing.

The serrated plate is of less width than the wall against which the plate is clamped. In this way, after the mounting screws have been loosened, the housing may be moved laterally of the cabinet to adjust the position of the housing relative to the cabinet and the mounting screws re-tightened.

A cover is also mounted on the housing in seal tight relation in order to seal off the apertures and mounting screws and eliminate any exposed gaps between the cover and housing.

These and other objects of the invention will become more apparent from the following description taken in conjunction with the accompanying drawings wherein.

Figure 1:
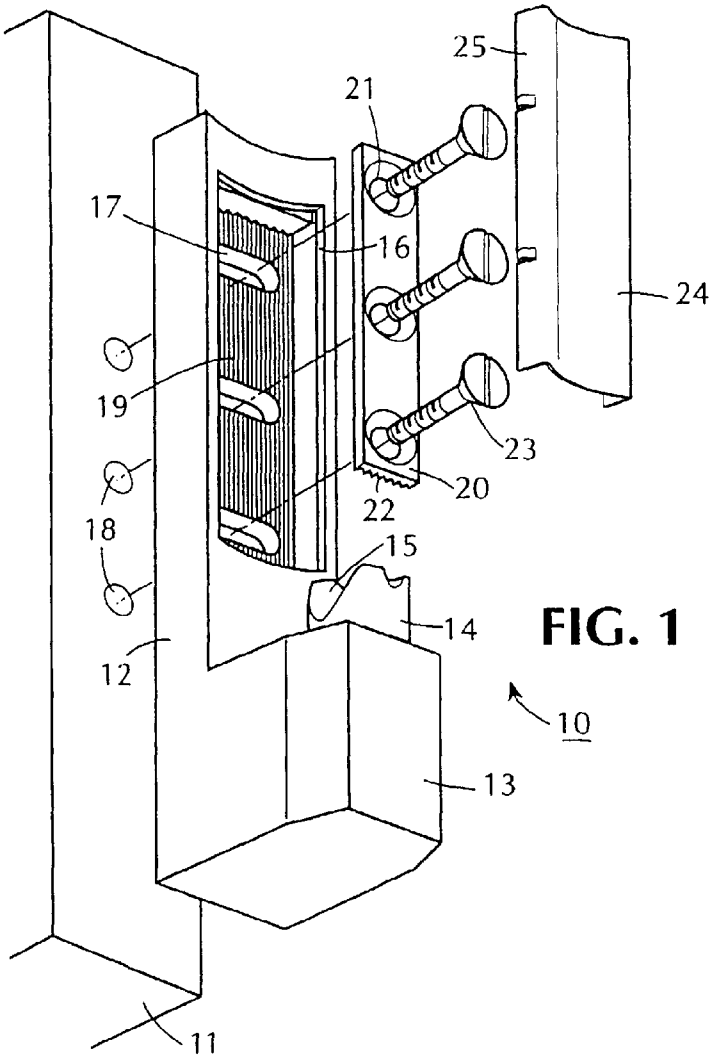
FIG. 1 illustrates an exploded the view of the hinge component of a hinge assembly constructed in accordance with the invention as mounted on a cabinet.

Referring to FIG. 1, the hinge component 10 of the hinge assembly is sized to be mounted on a cabinet 11, for example of a reach-in refrigerator, and is made of one-piece construction. As shown, the hinge component 10 has a vertical wall 12 having a flat back for disposition against a flat surface of the cabinet 11 and a base 13 which projects from one end of the wall 12. A cam member 14 is mounted in the base 13 and has a central bore (not shown) for purposes as described below. The cam member 14 is of conventional structure and has a circular cam surface 15 thereon about the bore.

The housing 10 also has a recess 16 within the vertical wall 12 and a plurality of horizontally elongated apertures 17 within the recess 16 which are aligned with threaded apertures 18 in the cabinet 11. The bottom of the recess 16 is formed with a plurality of serrations 19 which run vertically and in parallel relation perpendicularly of the elongated apertures 17.

A plate 20 of less width than the recess 16 in the wall 12 is disposed within the recess 16 to abut the serrations 19. The plate 20 includes a plurality of apertures 21 aligned with the elongated apertures 17 in the wall 12 and a plurality of serrations 22 for selective engagement with the serrations 19 in the recess 16 of the wall 12. The width of the plate 20 relative to the recess 16 is such that the plate 20 may be move laterally of the elongated apertures 17. For example, the plate 20 may have a width which is one-half the overall width of the wall 12 and two-thirds the width of the recess 16. That is to say, for a recess 16 having a width of ¾ inch, the width of the plate 20 would be ½ inch.

A plurality of mounting screws 23 are also provided for securing the housing 10 to the cabinet 11. As shown, each mounting screw 23 passes through an aperture 21 of the plate 20 and an elongated aperture 17 in the housing wall 12 into threaded engagement with an aperture 18 in the cabinet 11. Upon tightening of the screws 23, as with a screwdriver, the plate 20 is clamped against the wall 12 of the housing 10 and the serrations 22 of the plate 20 move into mating relation with the serrations 19 of the wall 12 to firmly secure the plate 20 against lateral movements relative to the wall 12.

A cover 24 is mounted on the wall 12 to close the recess 16 and thereby dispose the plate 20 and mounting screws 23 in a closed sealed space while eliminating any exposed gaps. As shown, the cover 24 is in the form of a thin plate of substantially U-shape with a pair of parallel flexible flanges 25 which can be snapped into place within opposite sides of the recess 16. When in place, the cover 24 completely seals off the recess 16 in seal-tight relation from the outside environment.

In order to make adjustments in the mounting of the hinge component 10 on the refrigerated cabinet 11, the cover 24 is first removed from the wall 12 to expose the screws 23. Next, the screws 23 are loosened to the extent that the plate 20 may be disengaged from the serrations 19 of the wall 12 and the housing 10 moved laterally of the cabinet 11. Upon re-positioning of the housing 10 on the cabinet 11, the screws 23 are tightened, as by a screwdriver, to again clamp the plate 20 against the wall 12 with the serrations 19, 22 in engagement and, thus, the housing 10 against the cabinet 11. Thereafter, the cover 24, is snap-fitted back into the recess to seal off the screws 23 and, in particular, the elongated slots 17.

Figure 2:
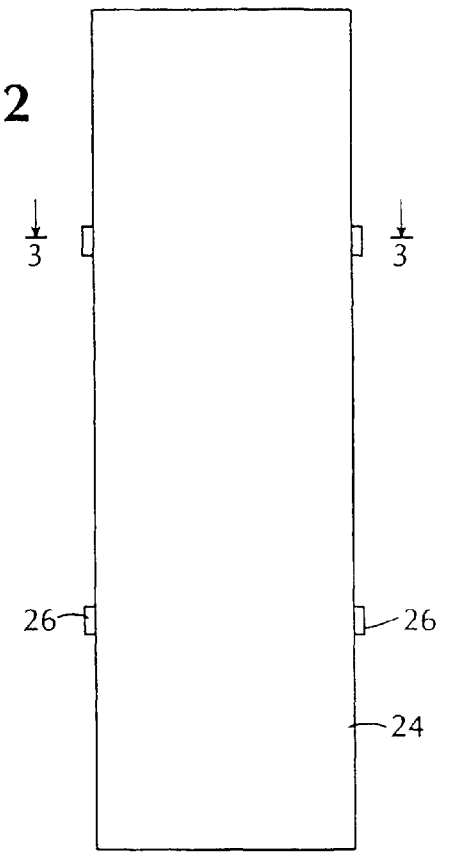
FIG. 2 illustrates a front view of the cover of the housing of FIG. 1.
Figure 3:
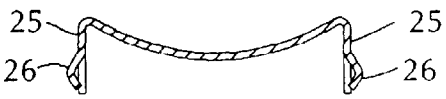
FIG. 3 illustrates a cross-sectional view taken on line 3—3 of FIG. 2.

Referring to FIGS. 2 and 3 of 10, each flange 25 of the plate 24 has a pair of detents or tabs 26 which extend outwardly in order to be snap-fitted in corresponding grooves (not shown) in the wall 12.

Figure 4:
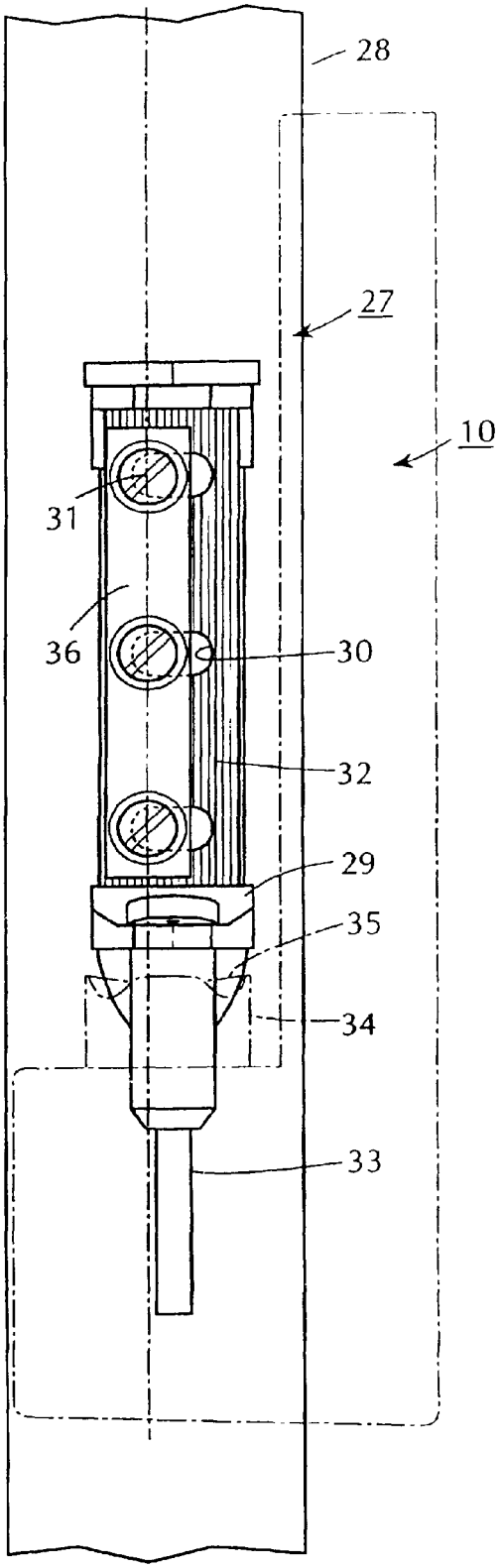
FIG. 4 illustrates a front view of the post member of a hinge assembly constructed in accordance with the invention.
Figure 5:
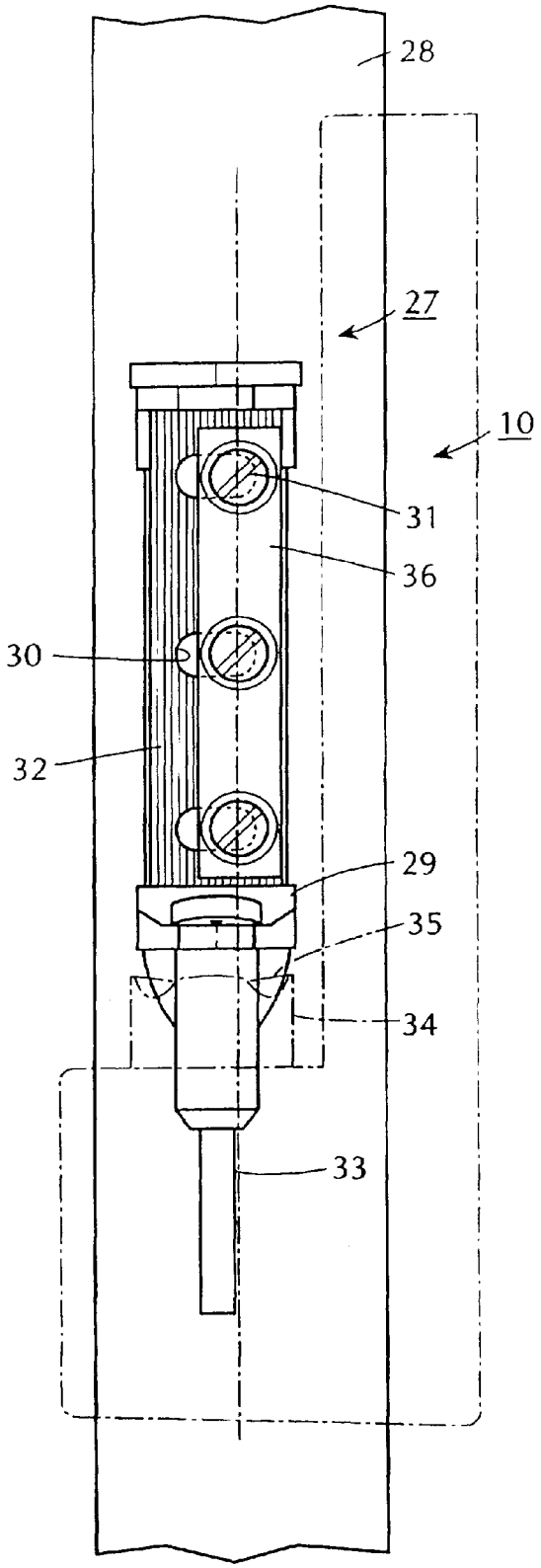
FIG. 5 illustrates a view similar to FIG. 4 of the post member moved to a different position in accordance with the invention.

Referring to FIGS. 4 and 5, the post member 27 of the hinge assembly is sized to be mounted on a door 28 and has a wall 29 with a flat back which is to be secured flush to a flat surface of the door 28. The wall 29 includes a plurality of horizontally elongated apertures 30 which are vertically spaced apart in order to receive mounting screws 31 which pass through the apertures 30 into threaded engagement with corresponding threaded apertures in the door 28. In addition, the wall 29 is provided with a plurality of parallel serrations 32.

The post member 27 also has a depending pin 33 which is to fit within the bore in the cam member 14 of the housing 10 so that the post member 27 is pivotally mounted on the housing 10. In addition, the post member 27 has an integral cam member 34 with a circumferential cam surface 35 which mates with the cam surface 15 of the cam member 14 on the housing 10. The cam surfaces 15, 35 are shaped so that as the post member 27 pivots on the housing 10, the door 28 may be moved from a closed position over the cabinet 11 to an intermediate open position and then to a fully open position as is conventional.

As shown in FIG. 4, a plate 36 is mounted against the wall 29 of the post member 27 and has a plurality of apertures through which the mounting screws 31 pass for this purpose. As above, the plate 36 is provided with a plurality of serrations (not shown) for mating engagement with the serrations 32 on the post member 27. In addition, as above, the plate 36 is of lesser width than the post member 27 so that the plate 36 may be moved laterally relative to the post member 27.

By loosening the mounting screws 31, the post member 27 may be moved laterally of the plate 36 and thereby laterally of the door 28 for adjustment purposes. At the same time, the serrations on the plate 36 move over different serrations 32 of the post member 27. Upon re-tightening of the screws 31, the plate 36 moves into the serrations 32 of the post member 27 to clamp the plate 36 against the post member 27 and, thus, the post member 27 against the door 28.

A cover with a U-shaped cross-section (not shown) is also provided for fitting over the post member 27 in order to enclose the plate 36 and mounting screws 31 and provide a clean aesthetic appearance.

Each of the housing 10 and the post member 27 may be provided with apertures of a different shape from that described above so as to provide for vertical adjustments as well as the horizontal adjustments described above.

The invention thus provides an adjustable hinge assembly for mounting a door on a refrigerated cabinet while eliminating any exposed gaps in which bacteria, microbes and the like might accumulate.

The invention also provides simple elements which can be incorporated in a hinge assembly in order to allow horizontal and /or vertical adjustments to be made using readily available simple tools.

What is claimed is:

1. A hinge assembly comprising a housing having a wall for vertical deposition against a cabinet and a base projecting from one end of said wall, said wall having a plurality of longitudinally spaced apart apertures, each said aperture being of elongated shape;

an elongated plate disposed against said wall and over said spaced apart apertures in said wall, said plate having a plurality of longitudinally aligned apertures therein disposed over said apertures in said wall;

a plurality of mounting screws, each screw passing through a respective one of said aperture in said plate and one of said apertures in said wall to clamp said plate to said wall; and a cover mounted on said housing in seal tight relation to seal off said apertures and said screws.

2. A hinge assembly as set forth in claim 1 whereby said plate is of a lesser width than said wall of said housing to move laterally thereof.

3. A hinge assembly as set forth in claim 1 wherein said wall of said housing has a plurality of parallel serrations and said plate has a plurality of serrations in selective engagement with said serrations of said wall.

4. A hinge assembly as set forth in claim 1 wherein said wall of said housing has a recess receiving said apertures and said screws and wherein said cover is received in seal-tight relation in said recess.

5. A hinge assembly as set forth in claim 4 wherein said cover is snap-fitted in said recess.

6. A hinge assembly as set forth in claim 5 wherein said cover is a U-shaped thin plate having a pair of parallel flexible flanges snap-fitted into said recess.

7. An adjustable hinge assembly comprising a housing having a vertically disposed wall with a plurality of vertically spaced apart horizontally elongated apertures;

an elongated plate disposed against said wall and over said spaced apart apertures in said wall, said plate having a plurality of longitudinally aligned apertures therein disposed over said apertures in said wall;

a plurality of mounting screws, each screw passing through a respective one of said aperture in said plate and one of said apertures in said wall to clamp said plate to said wall; and a cover releaseably mounted on said housing to seal said apertures and said screws therein.

8. An adjustable hinge assembly as set forth in claim 7 whereby said plate is of a lesser width than said wall of said housing to move laterally thereof.

9. An adjustable hinge assembly as set forth in claim 7 wherein said wall of said housing has a plurality of parallel serrations and said plate has a plurality of serrations in selective engagement with said serrations of said wall.

10. An adjustable hinge assembly as set forth in claim 7 wherein said housing has an elongated recess receiving said plate and said cover.

11. An adjustable hinge assembly as set forth in claim 10 wherein said cover is a U-shaped thin plate having a pair of parallel flexible flanges snap-fitted into said recess.

12. In combination, a refrigerated cabinet;

a housing having a plurality of horizontally elongated apertures therein;

a plate disposed in said housing for selective horizontal movement relative to said apertures, said plate having a plurality of apertures therein in alignment with said apertures of said housing;

a plurality of mounting screws, each screw passing through a respective one of said apertures in said plate and one of said apertures in said wall into said cabinet to secure said housing to said cabinet; and a cover releaseably mounted on said housing to seal said apertures and said screws therein.

13. The combination as set forth in claim 12 wherein said housing has a vertical wall receiving said horizontally elongated apertures, a recess receiving said plate and a plurality of serrations on said wall and wherein said plate has a plurality of serrations in selective engagement with said serrations of said wall.

14. The combinations as set forth in claim 13 whereby said plate is of a lesser width than said wall of said housing to move laterally thereof.

15. An adjustable hinge assembly as set forth in claim 13 wherein said cover is a U-shaped thin plate having a pair of parallel flexible flanges snap-fitted into said recess.

* * * * *

UNITED STATES PATENT AND TRADEMARK OFFICE

CERTIFICATE OF CORRECTION

PATENT NO. : 6,152,554
DATED : November 28, 2000
INVENTOR(S) : Bernard Parisi

It is certified that error appears in the above-identified patent and that said Letters Patent is hereby corrected as shown below:

Column 4, line 22 change "deposition" to -disposition-

Line 32 change "aperture" to -apertures-

Line 63 change "aperture" to -apertures-

Signed and Sealed this

Eighth Day of May, 2001

*Attest:*

Nicholas P. Godici

NICHOLAS P. GODICI

*Attesting Officer*

*Acting Director of the United States Patent and Trademark Office*